United States Patent [19]

Morrison

[11] Patent Number: 4,892,438

[45] Date of Patent: Jan. 9, 1989

[54] SCREED CONSTRUCTION AND METHOD

[76] Inventor: Donald R. Morrison, 9827 Mt. Holly Rd., Rte. 6, Box 634, Charlotte, N.C. 28208

[21] Appl. No.: 292,269

[22] Filed: Dec. 30, 1988

[51] Int. Cl.[4] ..... B28B 1/08; E01C 19/40

[52] U.S. Cl. ..... 404/119; 403/223; 52/694; 425/456

[58] Field of Search ..... 409/97, 118, 119, 114, 409/120; 403/171, 172, 176, 223; 52/694; 72/369; 297/445; 182/179; 29/446, 505, DIG. 3; 228/126, 129, 173.4, 189; 425/456

[56] References Cited

U.S. PATENT DOCUMENTS

| | | | |
|---|---|---|---|
| 3,456,415 | 7/1969 | Shaffer | 52/694 |
| 4,208,037 | 6/1980 | Le Gal | 403/223 X |
| 4,285,609 | 8/1981 | Runyon | 403/172 |
| 4,340,351 | 7/1982 | Owens | 404/118 X |
| 4,386,901 | 6/1983 | Morrison | 404/118 X |

OTHER PUBLICATIONS

Allen Razorback Vibratory Air Screed; 1982.

*Primary Examiner*—William P. Neuder
*Attorney, Agent, or Firm*—Olive & Olive

[57] ABSTRACT

A frame member for use as a portion of an open portable vibrated screed frame comprises a length of metal rod with metal tubes spaced along the length of the rod and bent in a zig-zag configuration such that each tube and a portion of the rod within each tube is bent together thereby providing a means for securing the frame member by welding to the tubes rather than directly to the rod material.

4 Claims, 1 Drawing Sheet

SCREED CONSTRUCTION AND METHOD

BACKGROUND OF INVENTION

1. Field of Invention

This invention relates briefly to welded constructions and more specifically to a welded screed construction and a method of making such construction.

2. Background Art

One extensively used form of portable vibrated screed used for screeding concrete between two forms has a frame comprising a network of individually cut metal rods extending between a ridge member in the form of a tube or plate at the top of the screed and front and rear, spaced apart, screed blades at the base of the screed. Individual rods are welded to the ridge member at one end and to one of the screed blades at the opposite end to form the sides of an open screed frame of triangular cross section. Other rods are welded to and between the blades to form the base. U.S. Pat. No. 4,249,327 illustrates use of what are typically individually cut and welded metal rods to form the frame of a portable vibrated screed using individual air vibrators. While not illustrating a rod type frame, U.S. Pat. No. 4,253,778 illustrates another type of widely used portable vibrated screed in which the vibration is achieved by a vibrating shaft. This type of shaft vibrated screed also lends itself to having the frame formed of rods. Other portable vibrated screeds use individual electric vibrators rather than individual air vibrators.

The ends of the individual rods which are welded to the ridge member do not tend to break at the weld joints. However, the ends of the individual rods forming the side of the frame and welded to the screed blades to tend to break loose at the weld joints due to the vibration and severe service conditions imposed on the blades. The entire screed then has to be taken out of service and repaired.

The object of the present invention is thus to provide an improved screed construction for a portable vibrated screed using an open network of rods to form the frame but with a construction and method of construction that reduces and substantially eliminates any opportunity for the rod welds to break loose from the screed blades. Other objects will become apparent as the description proceeds.

SUMMARY OF INVENTION

According to the invention a portable screed frame suited for use in an air, electric or shaft vibrated concrete screed is made up of a network of metal bars. Each side or at least a portion of each side of the frame is formed of a single metal bar bent in a zig-zag form. Weld joints attach the bends at the top of the bent bar and the upwardly extending terminal ends of the bar to a ridge member. The bottom bends of the bar mount short sections of metal tube which are placed over the frame side rod at each bottom bend location and are bent to conform with bending of the frame side rod. These tubes which mount the bottom bends to the side rod provide substantial welding surface and are welded to metal plates which are bolted or welded to the screed blades on each side of the screed thereby providing secure weld joints at the base of the screed and which withstand the vibration and severe service conditions without breaking.

DESCRIPTION OF PREFERRED EMBODIMENT

The method of forming and assembling one side or at least a portion of one side of a metal rod formed frame for a portable vibrating screed is described and illustrated according to the invention. The side of the frame are only partially shown and are intended to be of similar construction. Various elements such as cross braces and cross bracing between the screed blades are not shown to simplify the description.

Figure 1:
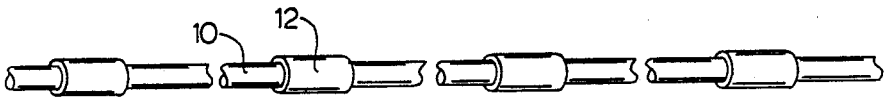
FIG. 1 illustrates a metal rod with a series of spaced apart metal tubes or sleeves prior to being formed for use as one side of a vibrated screed frame.
Figure 2:
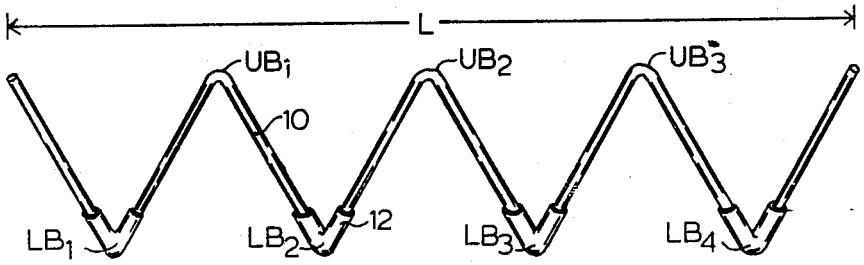
FIG. 2 illustrates the rod-tube assembly of FIG. 1 bent into a zig-zag form suited for use as one side or at least a portion of one side of a vibrated concrete screed frame.

In FIG. 1, there is illustrated a single, straight metal rod 10 having a series of spaced apart metal tubes 12 loosely fitted on rod 10 at locations corresponding to locations where the rod is to be bent at the bottom of the frame. In the next operation seen in FIG. 2, rod 10 and tubes 12 are shown bent together with rod 10 in a zig-zag form and assuming a length L representing either the entire or some selected portion of the length of an overall rod formed screed frame. Rod 10 terminates with upper ends **10*a*, 10*b* and is formed with upper bends UB1, UB2 and UB3 and lower bends LB1, LB2, LB3 and LB4, mounting tubes 12**, now bent, each of which provides substantial welding area.

Figure 3:
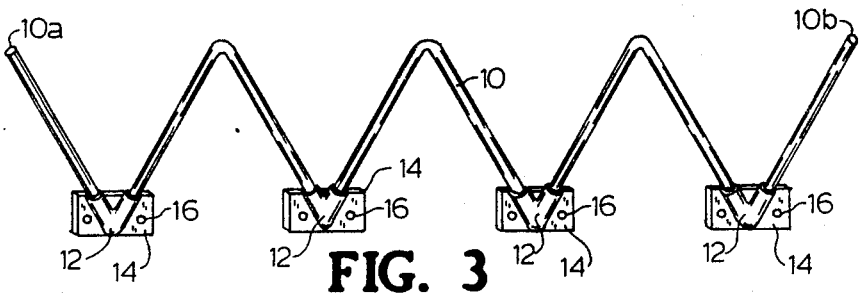
FIG. 3 illustrates the bent rod-tube assembly of FIG. 2, with welded on screed blade attachment plates.
Figure 4:
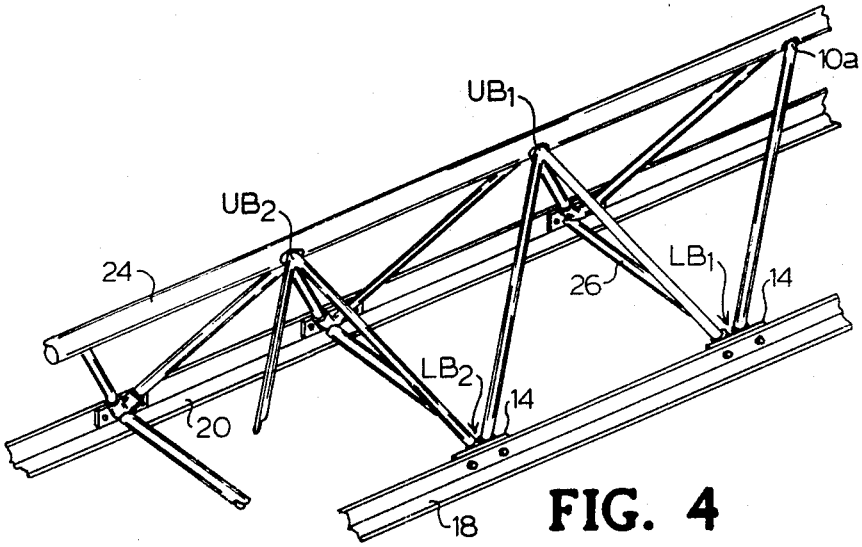
FIG. 4 illustrates portions of a pair of the bent rod-tube-plate assemblies of FIG. 3 attached to a pair of screed blades and forming the sides of a portable vibrated concrete screed frame.

In FIG. 3, a series of rectangular metal plates 14 have each been welded to a selected bent tube 12. Each plate 14 is provided with a pair of bolt holes 16 and in FIG. 4, a portion of the rod-tube-plate assembly of FIG. 3 is shown bolted to a screed blade 18 with upper bends UB1 and UB2 and rod ends **10*a* being welded to the ridge member 24 illustrated as an air tube such as shown in the mentioned U.S. Pat. No. 4,249,327. It will be understood that upper bends UB3 and rod end 10*b*, not shown in FIG. 4, are similarly welded. An opposite screed blade 20 is shown attached to a portion of a side frame of similar construction. Cross braces 26 are illustrated as being welded to the tube 12**.

From the foregoing, it can be seen that an entire side frame or a selected portion of a side frame can be formed in one operation, that individual side frame rods are no longer required to be cut, that the ends of the side frame rods are no longer required to be welded directly to the heavily vibrated screed blades and that longer service life is assured. The bent tubes thus provide substantial welding area for securing the bottom portions of the side frames to the screed blades. The weld joints which secure the upper bends UB1, UB2 and UB3 are also now able to utilize a larger welding area provided by the upper bends. While described as being bolted, it is recognized that plates 14 may be secured to the respective screed blades 18, 20 by welding.

What is claimed is:

1. A frame side construction for a portable vibrating concrete screed having a pair of screed blades on an open frame of triangular cross section comprising:

(a) a rod-tube assembly, comprising:

(i) a single continuous metal frame rod bent back and forth in a zig-zag configuration so as to define plural lower and upper bent portions connected by straight portions of the rod and terminating with upper rod ends; and (ii) a plurality of loosely fitted tubular metal sleeves mounted on and correspondingly bent on each lower bent portion of the screed frame, said bent frame rod extending for a selected portion of the length of the screed;

(b) a metal ridge member forming the apex of the portion of the screed frame corresponding to the effective length of said rod-tube assembly, each of said upper bent portions and the upper terminal ends of said rod being welded to said ridge member;

(c) a screed blade corresponding in length to the length of said rod-tube assembly and comprising one of a pair of screed blades for the screed in which said frame side construction is to be employed;

(d) a plurality of metal plate welded to each of said tubular metal sleeves on said lower bent portions and positioned for being secured to said screed blade; and (e) means joining each of said metal plates to said screed blade to form a frame side for a portable vibrating concrete screed intended to use said frame side.

2. A frame side construction as claimed in claim 1 wherein said metal plates are secured to said screed blade by bolt type fasteners.

3. A frame side construction as claimed in claim 1 wherein said metal plates are secured to said screed blade by welding said plates to said blade.

4. The method of fabricating a side frame member for a portable vibrated concrete screed comprising the steps of:

(a) locating a plurality of spaced apart tubular metal sleeves on a single length of continuous metal rod intended for service as a side member of a screed frame;

(b) bending said continuous metal rod in a back and forth, zig-zag configuration with selected bends in the rod coinciding with the locations of the said tubular metal sleeves such that each sleeve and the portion of the rod within each said sleeve are bent together; and (c) securing the tubular metal sleeves tubes and terminal ends of the rod to other metallic members forming part of the frame in which the frame member is installed.

* * * * *

UNITED STATES PATENT AND TRADEMARK OFFICE

CERTIFICATE OF CORRECTION

PATENT NO. : 4,892,438

DATED : January 9, 1990

INVENTOR(S) : Donald R. Morrison

It is certified that error appears in the above-identified patent and that said Letters Patent is hereby corrected as shown below:

Col. 1, line 35, correct "to" (second appearance) to read --do--.

Col. 3, line 29, correct "plate" to read --plates--.

Signed and Sealed this

Thirteenth Day of November, 1990

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,892,438

DATED : January 9, 1990

INVENTOR(S) : Donald R. Morrison

It is certified that error appears in the above-identified patent and that said Letters Patent is hereby corrected as shown below:

Correct the Date of Patent on title page, item [45] should read "Jan. 9, 1990."

Signed and Sealed this

First Day of January, 1991

*Attest:*

HARRY F. MANBECK, JR.

*Attesting Officer*

*Commissioner of Patents and Trademarks*